US005343702A

United States Patent [19]

Miyajima et al.

[11] Patent Number: 5,343,702

[45] Date of Patent: Sep. 6, 1994

[54] ZEOLITE CONVERTER FOR DIESEL ENGINE

[75] Inventors: Kiyoshi Miyajima; Hiroshi Oikawa; Yoichiro Kono, all of Tokyo; Yasuaki Kumagai, Kanagawa; Shinji Nakayama, Tokyo; Hiroshi Nakagawa; Masayoshi Nakashima, both of Nagasaki, all of Japan

[73] Assignees: Mitsubishi Jidosha Kokyo Kabushiki Kaisha, Minato; Mitsubishi Jukogyo Kabushiki Kaisa, Tokyo, both of Japan

[21] Appl. No.: 798,751

[22] Filed: Nov. 27, 1991

[30] Foreign Application Priority Data

| | | | |
|---|---|---|---|
| Nov. 30, 1990 | [JP] | Japan | 2-340593 |
| Dec. 7, 1990 | [JP] | Japan | 2-407261 |
| Dec. 7, 1990 | [JP] | Japan | 2-407262 |
| Dec. 14, 1990 | [JP] | Japan | 2-400700[U] |

[51] Int. Cl.[5] ..... F01N 3/28; F02B 7/00

[52] U.S. Cl. ..... 60/285; 60/301; 123/431

[58] Field of Search ..... 60/274, 285, 301; 123/431

[56] References Cited

U.S. PATENT DOCUMENTS

| | | | |
|---|---|---|---|
| 2,221,405 | 11/1940 | Nallinger | 123/431 |
| 4,165,610 | 8/1979 | Iizuka | 60/285 |
| 4,297,328 | 10/1981 | Ritscher | 60/301 |
| 4,452,040 | 6/1984 | Kobashi | 60/285 |
| 4,524,730 | 6/1985 | Doell . | |
| 4,881,369 | 11/1989 | Kanesaki | 60/285 |
| 4,929,581 | 5/1990 | Steinwandel | 60/299 |
| 5,050,550 | 9/1991 | Gao | 123/431 |

FOREIGN PATENT DOCUMENTS

| | | | |
|---|---|---|---|
| 228374 | 6/1969 | Russian Federation | 123/431 |
| 8300057 | 1/1983 | European Pat. Off. . | |
| 8113569 | 6/1983 | Japan . | |
| 36720 | 2/1985 | Japan | 123/431 |

*Primary Examiner*—Douglas Hart

[57] ABSTRACT

An exhaust gas purifier for a diesel engine is positioned in the middle of an inlet system for supplying air to a combustion chamber. The exhaust gas purifier includes an HC (hydrocarbon) supply source, and a zeolite catalyst converter, which is activated by the hydrocarbon as a reduction agent to crack NOx (oxides of nitrogen) in the exhaust gas, for thereby purifying the exhaust gas.

4 Claims, 8 Drawing Sheets

ZEOLITE CONVERTER FOR DIESEL ENGINE

BACKGROUND OF THE INVENTION

1. Field of the Invention

This invention relates to an exhaust gas purifier for purifying the exhaust gas emitted from a diesel engine to effectively crack oxides of nitrogen (NOx), for thereby discharging clean waste gas.

2. Description of the Related Art

If fuel were theoretically completely burned, an exhaust gas emitted from a vehicle engine should contain only $CO_2$ (carbon dioxide), $H_2O$ (water) and N (nitrogen). However, since complete combustion of the fuel is actually unattainable, the exhaust gas usually contains CO (carbon monoxide), HC (hydrocarbon) and NOx (oxides of nitrogen) as well.

Oxide in the air is essential to burn fuel gas in the engine. Approximately a quarter of the air consists of oxide, while most of the remaining three quarters are nitrogen, and minute amounts of other components. Generally, the nitrogen and oxide exist independently and are not bonded to each other in the air. However when fuel gas is burned at a high temperature, the nitrogen is oxidized, and oxides of nitrogen NOx are formed as a by-product.

A gasoline engine for an ordinary motor vehicle has a three-way catalytic converter in its exhaust system. The three-way catalytic converter not only oxides CO and HC but also reduces NOx. For this purpose, the concentration of $O_2$ in the exhaust gas should be always kept as small as possible. When a carburetor or an electronically controlled fuel injection system with an air-to-fuel ratio control function is employed, it is necessary to control the concentration of $O_2$ to a stoichiometric ratio based on the air-to-fuel ratio feedback control by using an $O_2$ sensor. With the gasoline engine, the exhaust gas produced by the three-way catalytic converter includes CO, Hc and NOx and is discharged as a highly purified gas.

With a diesel engine widely used for a large motor vehicle such a bus or a truck, the three-way catalytic converter is not effective. The diesel engine is characterized in that air necessary for combustion is always supplied to the engine without controlling the amount thereof and that only the amount of the fuel is controlled. Specifically while the diesel engine is under a partial load, the fuel is burned with excessive air. Therefore, the oxide concentration in the exhaust gas is higher than the oxide concentration in the exhaust gas from the gasoline engine. A gas oil as a diesel engine fuel contains more S (sulfur) than the gasoline.

Generally speaking, the exhaust gas emitted from the diesel engine tends to have a CO concentration of 0.3% or less and 500 to 2000 ppm, and a relatively low HC concentration due to $C_1$ to $C_3$ and $C_8$ contained in the fuel. However, the NOx concentration is usually above 200 ppm, which is nearly equivalent to the NOx concentration of the exhaust gas of the gasoline engine. Specifically, a direct injection type diesel engine tends to show a higher NOx concentration.

Therefore, to decrease NOx, it is not advantageous to use the conventional three-way catalytic converter to the diesel engine without any modification. Further, the exhaust gas from the diesel engine usually contains a lot of smoke mainly consisting of carbon particulates. The three-way catalytic converter cannot effectively decrease the smoke. A variety of efforts have been made to decrease NOx and the smoke, but these efforts have been in vain.

SUMMARY OF THE INVENTION

It is therefore an object of this invention to provide an exhaust gas purifier for a diesel engine, in which a zeolite catalyst converter can effectively crack and decrease NOx by application of HC even when there is a high $O_2$ concentration, for suppressing the amount of soot to be outwardly dispersed from the diesel engine.

According to a first aspect of this invention, there is provided an exhaust gas purifier comprising: a main fuel injection nozzle for supplying a main fuel to a combustion chamber of the diesel engine; HC supply-means for supplying HC,(hydrocarbon), the HC supply means being located in the middle of an inlet system for supplying air to the combustion chamber; and a zeolite catalyst converter located in the middle of an exhaust gas passage for guiding exhaust gas from the combustion chamber, the zeolite catalyst converter being activated by hydrocarbon as a reduction agent to crack NOx (oxides of nitrogen).

With this arrangement, hydrocarbon (HC) supplied to the inlet system undergoes the explosion stroke in the combustion chamber, which is introduced to the exhaust gas passage, and the zeolite catalyst converter is activated, which cracks NOx (oxides of nitrogen) into $N_2$ and $O_2$. HC supplied to the inlet system is burned in the combustion chamber before the main fuel is supplied. Then the main fuel is injected into the combustion chamber through the main injection nozzle to be ignited. Therefore the main fuel can be sufficiently burned, for decreasing soot in an exhaust gas. The zeolite catalyst converter can be protected against being poisoned by the soot, and is therefore being able to crack NOx efficiently.

It is preferable that the HC supply means is operated while the inlet valve remains open. HC introduced to the inlet system blows into the combustion chamber during the inlet stroke. This HC is burned separately from the main fuel directly introduced into the combustion chamber. During this explosion stroke, unsaturated hydrocarbon is formed, and the catalytic converter is activated efficiently. Most of hydrocarbon in the exhaust gas is unsaturated hydrocarbon, which activates the catalytic converter as a reduction agent, for cracking NOx into $N_2$ and $O_2$ to decrease NOx.

Since HC from the HC supply means is burned in the combustion chamber before the main fuel is supplied and ignited, combustion of the main fuel is enhanced to decrease the soot.

It is also preferable that the HC supply means is operated prior to closure of the inlet valve, so that part of HC blows to the exhaust gas passage while both the inlet, and exhaust valves remain open.

With this arrangement, HC remaining in the combustion chamber undergoes the explosion stroke together with the main fuel, for decreasing the soot in the exhaust gas, and enhancing the activation of the zeolite catalyst converter by unsaturated hydrocarbon. When a lot of saturated hydrocarbon is contained in the exhaust gas, HC blown to the exhaust gas passage also promotes to activate the zeolite catalyst converter. The simple structure to dispose the HC supply means in the inlet system can assure a remarkable reduction of NOx as done by the HC supply means disposed in the exhaust gas passage. It is also possible to prevent incomplete combustion caused by a large amount of HC supplied to the inlet system.

As a further preferable embodiment, the HC supply means is operated only when the diesel engine works in the range where a large amount of NOx is formed, or when the exhaust temperature is above the temperature for activating the zeolite catalyst converter. Thus, the hydrocarbon can be saved.

Further, the fuel injection pump for the main fuel can be used for supplying the hydrocarbon (gas oil) to the HC supply means, thereby simplifying the structure of the exhaust gas purifier.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION FOR THE PREFERRED EMBODIMENTS OF THE PRESENT INVENTION

An exhaust gas purifier of a first embodiment will be described with reference to FIGS. 1 to 6.

Figure 1:
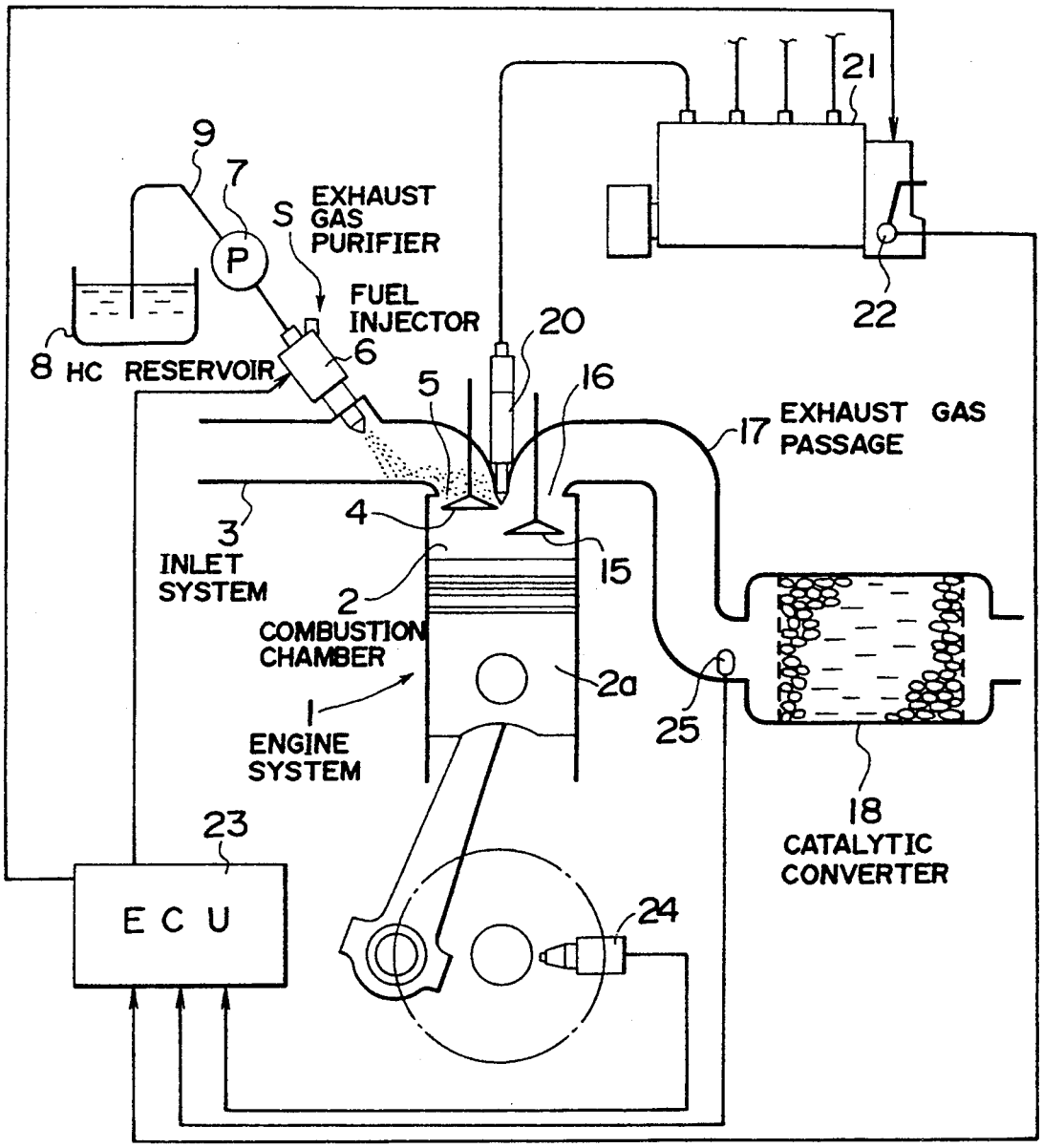
FIG. 1 shows an overall configuration of an exhaust gas purifier according to a first embodiment of this invention.

As shown in FIG. 1, an engine system 1 includes a combustion chamber 2, to which an inlet system 3 including inlet pipes is communicated. A fuel injector 6 for supplying hydrocarbon (hereinafter called "HC") is positioned at the middle of the inlet system 3, and confronts an inlet port 5 at an upper portion of the combustion chamber 2. The inlet port 5 is opened and closed by an inlet valve 4. The fuel injector 6 is connected to an HC reservoir 8 via a pump 7 and an HC supply pipe 9. The HC reservoir 8 stores a gas oil, gasoline or methanol as well as HC.

Figure 2:
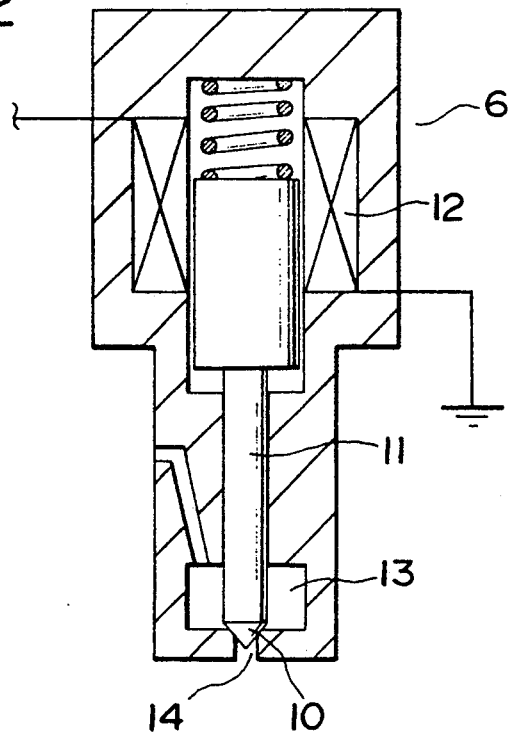
FIG. 2 is a cross-sectional view of a fuel injector.

As shown in FIG. 2, the fuel injector 6 includes a valve lever 11 having a pointed valve 10 at an end thereof. The pointed valve 10 opens an injection hole 14 when a solenoid 12 is energized. The HC supply pipe 9 (not shown in FIG. 2) is communicated to a guide member 13, which is located beside the pointed valve 10. Therefore, HC is ejected from the pointed valve 10 when the pointed valve 10 is opened. A valve opening timing is controlled to regulate the amount of HC.

Referring to FIG. 1 again, HC is delivered under pressure to the fuel injector 6 from the HC reservoir 8 via the pump 7. Therefore, HC in a mist form is injected toward the inlet port 5 when the injection hole 14 is opened.

An exhaust port 16 is positioned at the upper part of the combustion chamber 2. The exhaust port 16 is opened and closed by an exhaust valve 15, and is connected to an exhaust gas passage 17 through which an exhaust gas formed in the combustion chamber 2 is dispersed outwardly. A catalytic converter 18 is inserted in the middle of the exhaust gas passage 17.

The catalytic converter 18 mainly consists of a zeolitic catalyst. Specifically, a coppery zeolite catalyst (Cu/ZSM-5) or a hydrogeneous zeolite catalyst (H/ZSM-5) is optimum. The catalyst is either in the shape of pellet or monolith, and is housed in a container. This type of catalyst is activated by the hydrocarbon as a reduction agent, for efficiently cracking not only NOx into $N_2$ and $O_2$ but also HC into $H_2O$ and $CO_2$.

Figure 3:
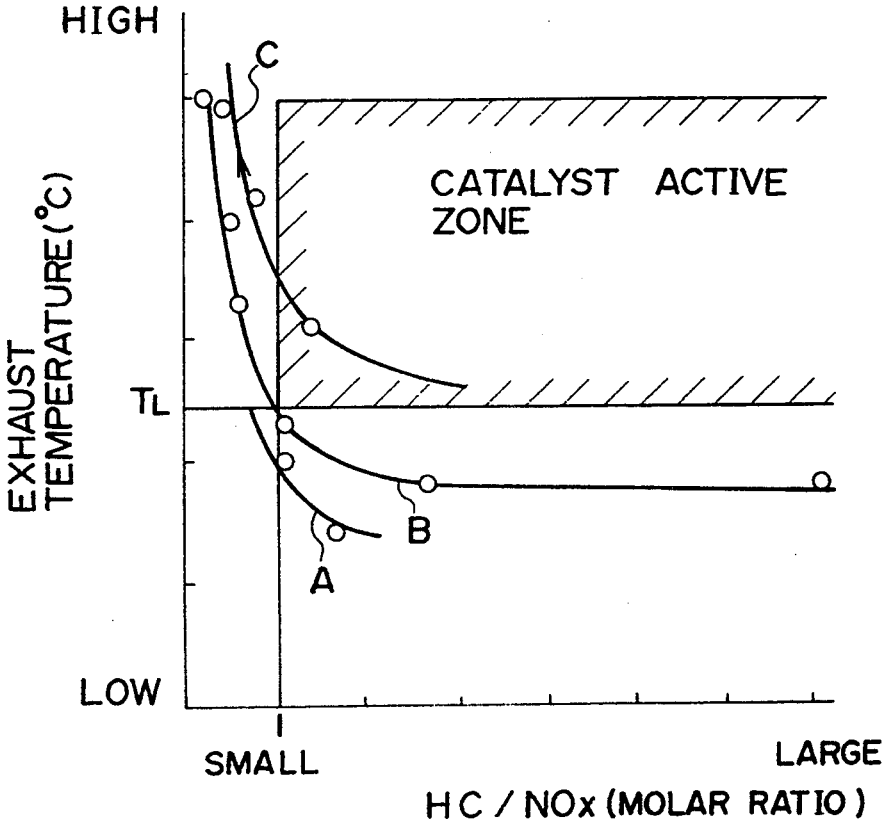
FIG. 3 is a graph showing characteristics of a catalytic converter in a zeolite catalyst catalyst active zone.

The zeolitic catalyst has an active zone as shown in FIG. 3. The abscissa represents a molar ratio which is a volumetric ratio of HC/NOx, and the ordinate represents an exhaust temperature. $T_L$ stands for the lowest temperature for the active zone of the zeolite catalyst. When the temperature is below $T_L$, the catalyst cannot function. The catalyst can function sufficiently in the temperature range above $T_L$. The active zone exists only when HC/NOx is 1 or more. The curves A, B and C indicate relationships between the exhaust temperatures and HC/NOx. In this case, these curves respectively correspond to a constant slow engine speed, a constant intermediate engine speed, and a constant high engine speed. As shown by an arrow, as the load becomes higher, HC/NOx is smaller than 1, and the exhaust temperature becomes higher.

As can be seen from FIG. 3, when the exhaust temperature is $T_L$ or more regardless of the engine speed, HC/NOx is usually 1 or less, which is outside the active zone of the zeolite catalyst (although only part of the high engine speed range is in the active zone). When HC/NOx is 1 or more, the exhaust temperature is $T_L$ or less, which is also outside the active zone of the zeolite catalyst.

Returning to FIG. 1 again, a main fuel injection nozzle 20 of the combustion chamber 2 is communicated to a fuel injection pump 21, which has a load sensor 22 on a load lever connected to an accelerator pedal (not shown). The load sensor 22 is electrically connected to an ECU 23. An engine speed/crankshaft angle sensor 24 is connected to ECU 23 via a crankshaft. A temperature sensor 25 is located upstream of the catalytic converter 18, and is electrically connected to ECU 23.

Figure 4:
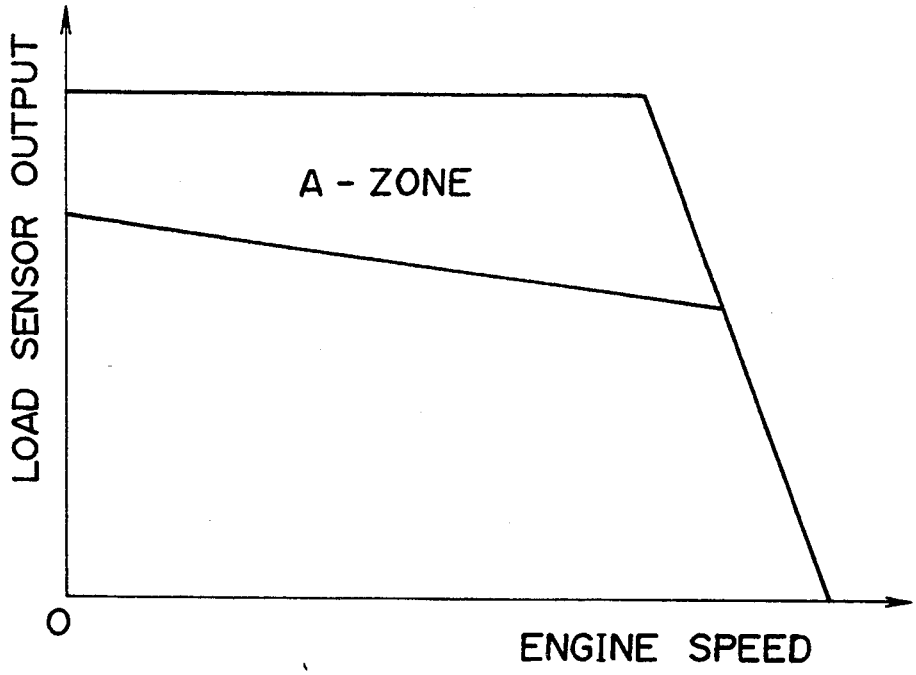
FIG. 4 shows operation characteristics of an engine system.

The fuel injector 6 is controlled by ECU 23 as described below. On receiving signals from the load sensor 22 and the engine speed/crankshaft angle sensor 24, ECU 23 decides whether or not the engine system is in a particular operating zone in which a lot of NOx is being formed. Specifically, as shown in FIG. 4, ECU 23 checks whether the engine system is in the zone whose data have been stored based on the load and engine speed, i.e. A-zone. When the detected amount of NOx deviates from the value for the A-zone, ECU 23 does not emit any signal. On the contrary, when the amount of NOx is the value for the A-zone, ECU 23 checks whether the exhaust temperature is $T_L$ or more based on the signal from the temperature sensor 25.

Figure 5:
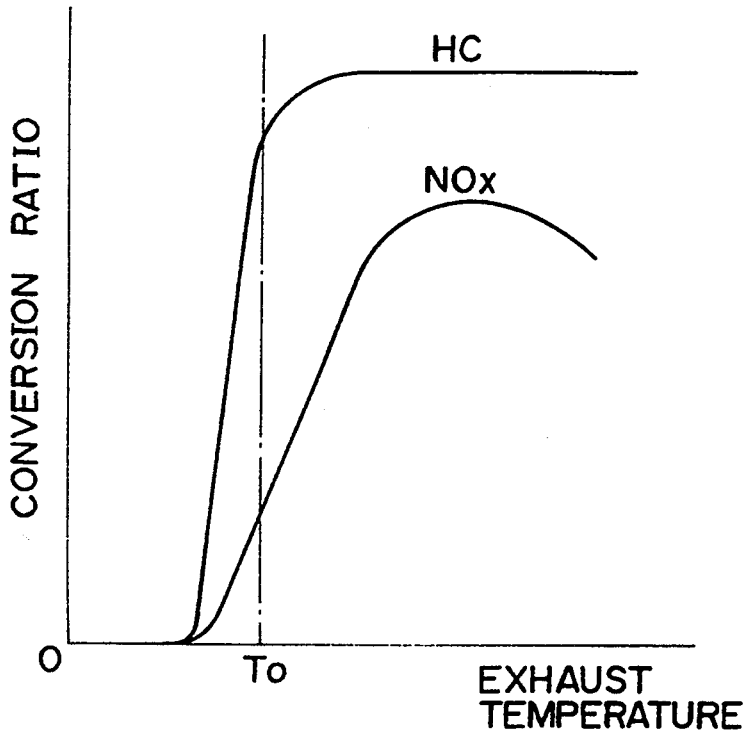
FIG. 5 shows a relationship between a conversion ratio of the zeolite catalyst converter and an exhaust temperature.

The zeolite catalyst converter 18 has conversion ratios for the exhaust temperature as shown in FIG. 5. In other words, the conversion ratios of HC and NOx do not become 0 or more unless the exhaust temperature exceeds a preset value, which means the zeolite catalyst converter 18 does not function as a catalyst. When the exhaust temperature becomes higher than the preset value, the zeolite catalyst converter 18 abruptly functions with remarkable effect in response to a minute increase of the temperature. Then, after the exhaust temperature exceeds the preset value, the conversion ratio for HC changes very slowly, and is constant thereafter. The conversion ratio for NOx has a peak after the conversion ratio for HC becomes constant. Therefore, a temperature $T_L$ which is slightly higher than the temperature where the zeolite catalyst converter 18 starts conversion is determined as an active temperature $T_L$, which is stored in ECU 23.

Knowing the detected temperature is $T_L$ or higher, ECU 23 reads experimental data on a NOx concentration based on the load and engine speed which have been stored according to the signals from the load sensor 22 and the engine speed/crankshaft angle sensor 24. ECU 23 calculates the molar number of HC based on the molar number of NOx to make HC/NOx equal to 1 or more, determines a valve opening timing, and sends a drive signal to the fuel injector 6 to supply HC to the inlet system 3.

Figure 6:
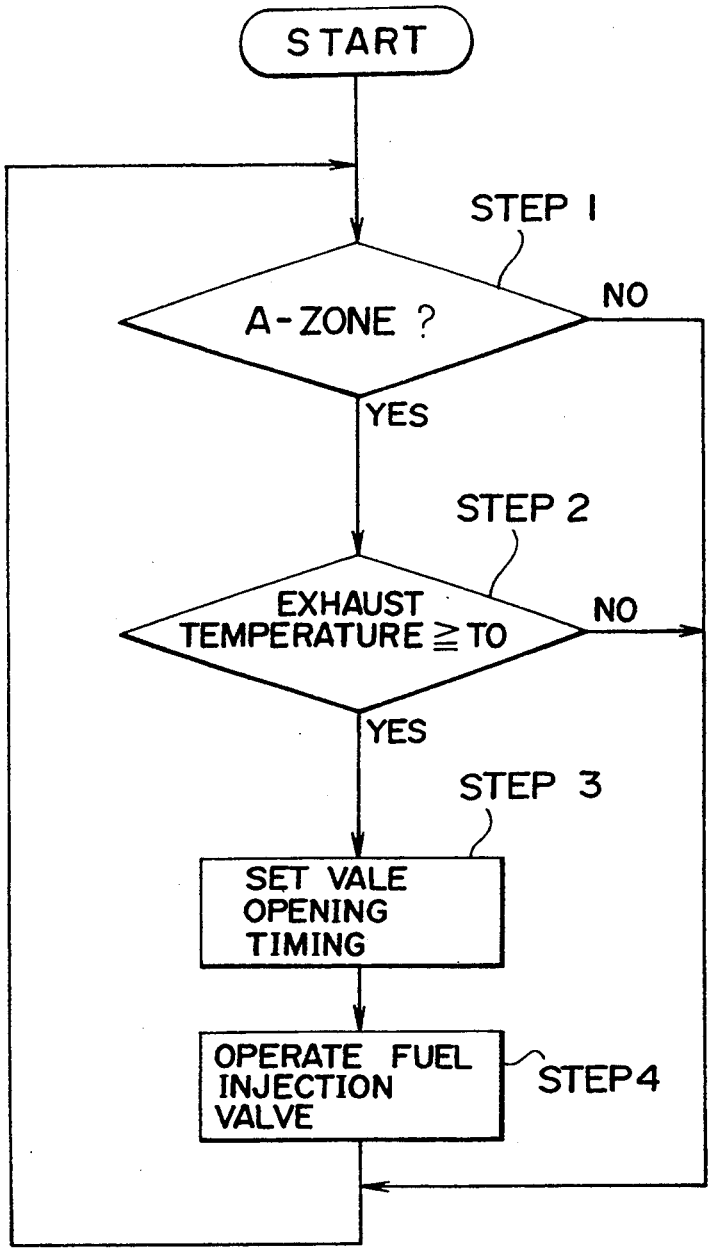
FIG. 6 is a flow chart showing a control process of the exhaust gas purifier of FIG. 1.

The operation of ECU 23 can be summarized by a flow chart illustrated in FIG. 6. Specifically, in the step 1, ECU 23 checks whether the engine system is working in the A-zone. When the engine system is in the A-zone, control goes to the step 2. ECU 23 checks whether the exhaust gas temperature is equal to or higher than the catalyst active temperature $T_L$. If the exhaust gas temperature is equal to or higher than the catalyst active temperature $T_L$, control goes to the step 3 to determine the valve opening timing. In the step 4, ECU 23 orders operation of the fuel injector 6. An operation timing of the fuel injector 6 is determined during an intake stroke based on the signal from the engine speed/crankshaft angle sensor 24.

When the engine system is found to be operating outside the A-zone in the step 1, and when the exhaust gas temperature is found lower than $T_L$, control returns to the step 1.

When the amount of HC to be supplied from the fuel injector 6 is determined, ECU 23 calculates an amount of the fuel corresponding to a calorific value of HC, corrects the calculated fuel amount, and sends a correction signal to the fuel injection pump 21 to let the main fuel injection nozzle 20 inject the fuel. In other words, the calorific energy generated by the fuel from the main fuel injection nozzle 20 and HC from the fuel injector 6 is determined to be equal to the calorific energy which is generated by the main fuel in a diesel engine without the fuel injector 6.

Operation of the exhaust gas purifier will be described hereinafter.

The engine system 1 operates as described above. Specifically, when the inlet valve 4 opens the inlet port 5, air for burning the fuel is introduced into the combustion chamber 2 via the inlet system 3. A piston 2*a* is raised to apply a high pressure to the air in the combustion chamber 2. The gas oil is supplied via the main fuel injection nozzle 20, is burned in the combustion chamber 2. Then, the exhaust valve 15 opens the exhaust port 16, and sends the exhaust gas from the combustion chamber 2 to the exhaust gas passage 17.

Theoretically, the fuel is uniformly burned in the combustion chamber 2. However, since a cylinder covering a wall of the combustion chamber 2 is usually cooled by water or air, an area near the inner circumference of the combustion chamber 2 is low in the temperature. Therefore, even when the center of the combustion chamber 2 has a high temperature, the area along the wall of the combustion chamber 2 functions as a quenching zone, causes incomplete combustion of the fuel. In addition, there is also incomplete combustion gas above a head of the piston 2*a*. Generally, HC is formed as the incomplete combustion gas on the quenching zone.

In the combustion chamber 2, HC from the fuel injector 6 is burned at a timing different from the timing to burn the fuel from the main fuel injection nozzle 20. Most of HC in the exhaust gas discharged to the exhaust gas passage 17 mainly consists of unsaturated hydrocarbon formed by the combustion.

Since the gas oil is burned together with oxide, $C_nH_{2(n+2)}+m\ H_2O_2$ is changed into $C_nH_{2(n+2-m)}+mH_2O$ (where n, m are variables).

The hydrocarbon is a compound composed of only carbon and hydrogen, which are bases for all of the organic compounds. The hydrocarbon is classified into saturated hydrocarbon and unsaturated hydrocarbon. The unsaturated hydrocarbon differs from the saturated hydrocarbon in that the unsaturated hydrocarbon has at least one double or triple carbon-to-carbon bond.

When the exhaust gas containing a lot of unsaturated hydrocarbon is introduced to the exhaust gas passage 17 and passes through the zeolite catalyst converter 18, the zeolite catalyst, e.g. coppery or hydrogeneous, is activated by the unsaturated hydrocarbon as a reduction agent, for thereby efficiently cracking NOx into $N_2$ and $O_2$. Thereafter, the exhaust gas having little NOx is expelled outside. At the same time, HC as the incomplete combustion gas is also efficiently cracked into $H_2O$ and $CO_2$.

Injected into the inlet system 3 by the fuel injector 6, HC flows into the combustion chamber 2 during the inlet stroke and is combusted prior to the fuel from the main fuel injection nozzle 20. Then, the fuel is injected from the main fuel injection nozzle 20, and is ignited, so that combustion of the fuel is enhanced to decrease the soot in the exhaust gas. This prevents the zeolite catalyst converter 18 from being poisoned by the ! soot, enabling the catalytic converter 18 to function efficiently.

The fuel injector 6 is always controlled to supply HC only when necessary depending upon the working condition of the engine system and the exhaust temperature. Therefore, when much NOx is formed and when the zeolite catalyst converter 18 should function sufficiently, HC is efficiently supplied without waste.

The calorific energy generated by HC from the fuel injector 6 and the fuel from the main fuel injection nozzle 20 is made to be equal to a calorific energy generated by a diesel engine without the fuel injector 6 as described above. Therefore, when the gas oil for the diesel engine is supplied as HC, the total amount of the fuel supplied from the fuel injector 6 and the main fuel injection nozzle 20 remains the same as a whole. A fuel consumption will not be disadvantageously affected.

With the foregoing embodiment, the HC reservoir 8 is particularly connected to the fuel injector 6 via the pump 7. This invention is not limited to such arrangement. For instance, the fuel injector 6 may be connected to a fuel tank, not-shown, to receive the fuel (gas oil) including HC as the main component.

A second embodiment of this invention will be described with reference to FIGS. 7 and 8. In this embodiment, HC is supplied to the fuel injectors 6 by another means in place of the pump 7 of the first embodiment. The gas oil is supplied as HC in this embodiment.

Figure 7:
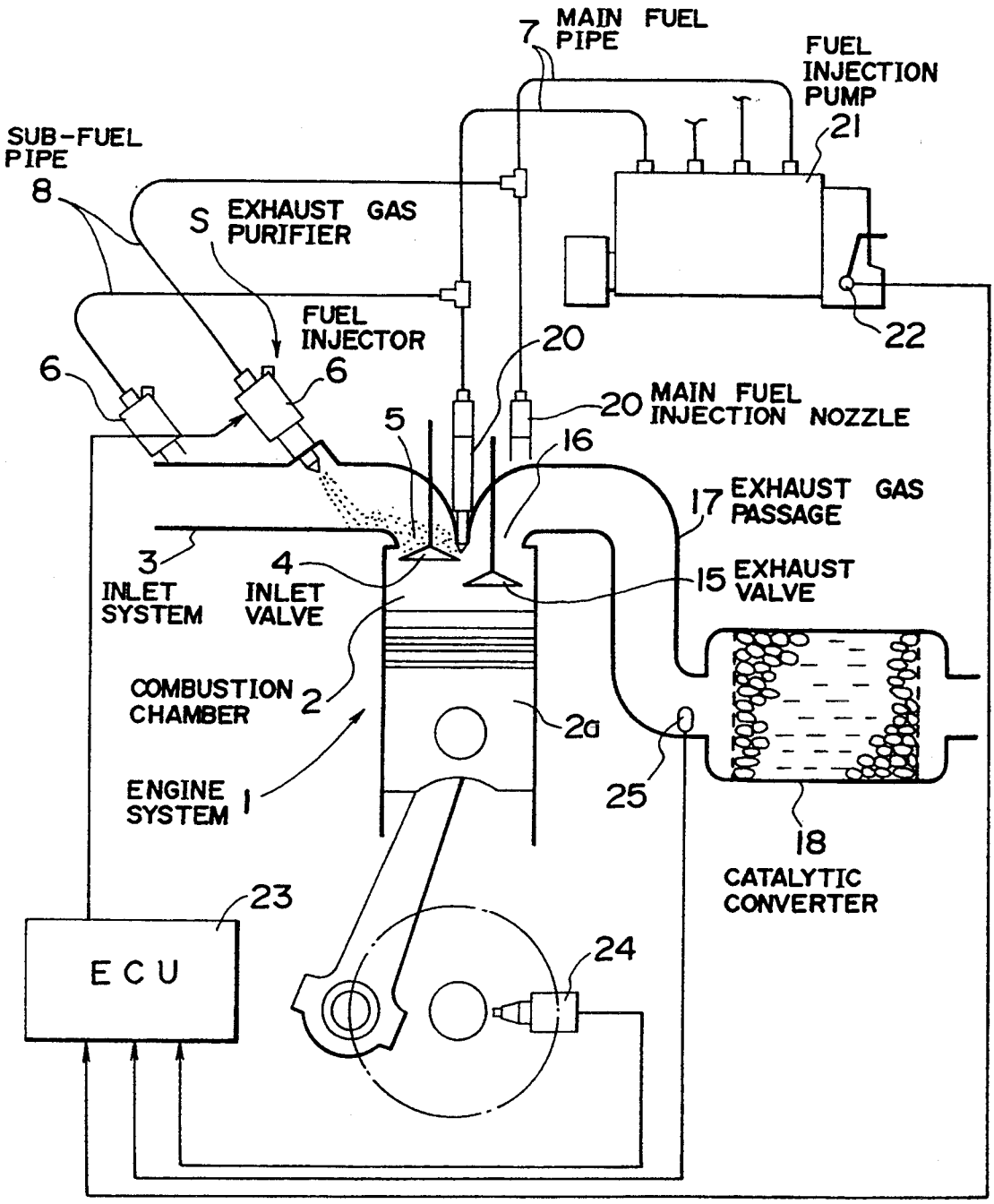
FIG. 7 shows an overall configuration of an exhaust gas purifier according to a second embodiment.

As shown in FIG. 7, the engine system 1 includes a multiplicity of combustion chambers 2, each of which has a main fuel injection nozzle 20. Only one of the combustion chambers 2 is exemplified in FIG. 7. The main fuel injection nozzle 20 is connected to a fuel injection pump 21 via fuel pipes 7.

Sub-fuel pipes 8 are connected to the middle of the fuel pipes 7 between the fuel injection pump 20 and the main fuel injection nozzle 20 in the combustion chamber 2. The sub-fuel pipes 8 are connected to the fuel injectors 6 of an inlet system 3 in a combustion chamber 2 different from the combustion chamber 2 in which the main fuel injection nozzle 20 is located.

In timed relationship with the combustion stroke of the fuel from the fuel injection nozzle 20 in the combustion chamber 2, the fuel is also supplied to the fuel injectors 6 of the different combustion chamber 2 during the inlet stroke.

Figure 8:
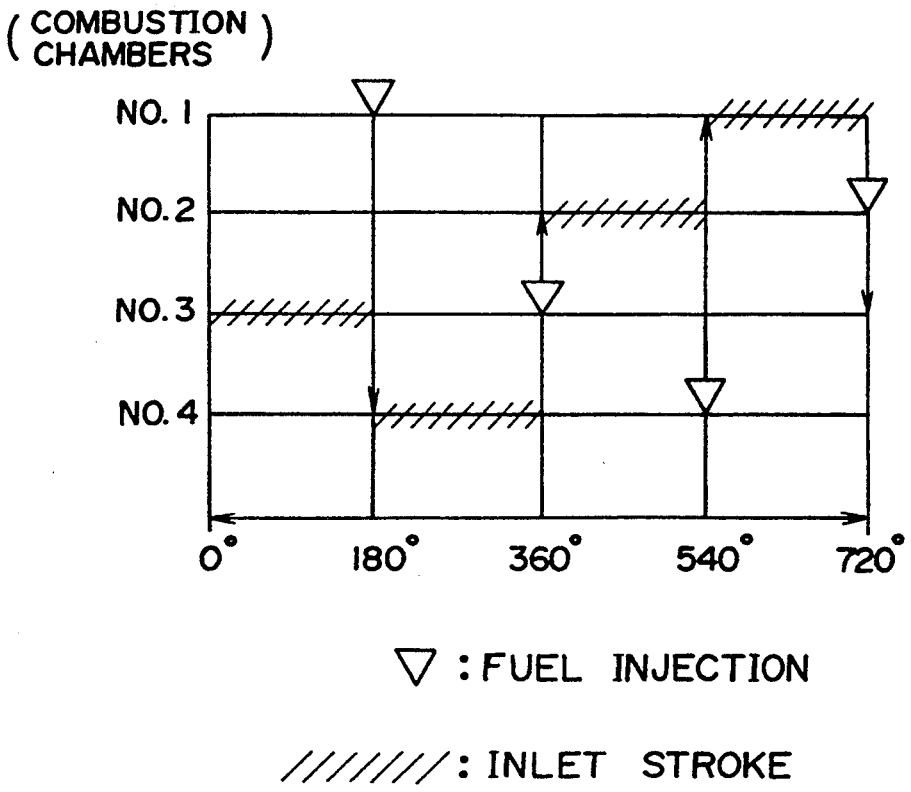
FIG. 8 shows fuel injection timings of combustion chambers.

Specifically, the foregoing relationship is shown in FIG. 8. The obliquely-lined portion represents the inlet stroke. In the rotational direction of the crankshaft, the compression stroke, explosion stroke and exhaust stroke are repeated in the named order. In timed relation with the explosion stroke of No. 1 combustion chamber, No. 4 combustion chamber starts the inlet stroke. Nos. 2 and 3 combustion chambers, Nos. 3 and 2 combustion chambers, and Nos. 4 and 1 combustion chambers have the same timed relation as above.

The main fuel pipes 7 to the main fuel injections nozzles 20, and the sub-fuel pipes 8 to the fuel injectors 6 are arranged to correspond to one another in a similar manner to the relationships between the combustion chambers.

Specifically, the sub-fuel pipe 8, which is branched from the fuel pipe 7 connected to the main fuel injection nozzle 20 for No. 1 combustion chamber, is connected to the fuel injector 6 connected to the inlet system 3 of No. 4 combustion chamber 2. Similarly, the fuel pipe 7 to the main fuel injection nozzle 20 of No. 2 combustion chamber 2 is connected to the sub-fuel pipe 8 of the fuel injector 6 for the inlet system 3 of No. 3 combustion chamber 2. The fuel pipe 7 to the nozzle 20 of No. 3 combustion chamber 2 is connected to the sub-fuel pipe 8 of the fuel injector 6 for the inlet system 3 of No. 2 combustion chamber 2. The fuel pipe 7 to the nozzle 20 of No. 4 combustion chamber 2 is connected to the sub-fuel pipe 8 of the fuel injector 6 for No. 1 combustion chamber 2.

With this arrangement, part of the fuel supplied from the fuel injection pump 21 via the fuel pipe 7 is bypassed to the fuel injector 6 via the sub-fuel pipe 8. The fuel injection timing of the fuel injector 6 is started in agreement with the inlet stroke of the combustion chamber 2 to which the inlet system 3 is communicated.

The main fuel, which is different from the fuel to the fuel injector 6, is supplied to a main fuel injection nozzle 20 in another combustion chamber 2 from the fuel pipe 7. The combustion chamber 2 having the fuel injection nozzle 20 starts the explosion stroke.

Therefore, it is not necessary to have a separate driving source and a separate fuel tank for storing the fuel to be supplied to the fuel injector 6. The timing for supplying the fuel to the fuel injector 6 can be easily controlled, for thereby assuring reliable operation of the exhaust gas purifier.

The total amount of the fuel from the main fuel injection nozzle 20 and the fuel injector 6 can be easily controlled to be always constant by sending the correction signal to the fuel injection pump 21 as described in connection with the first embodiment of this invention.

Figure 9:
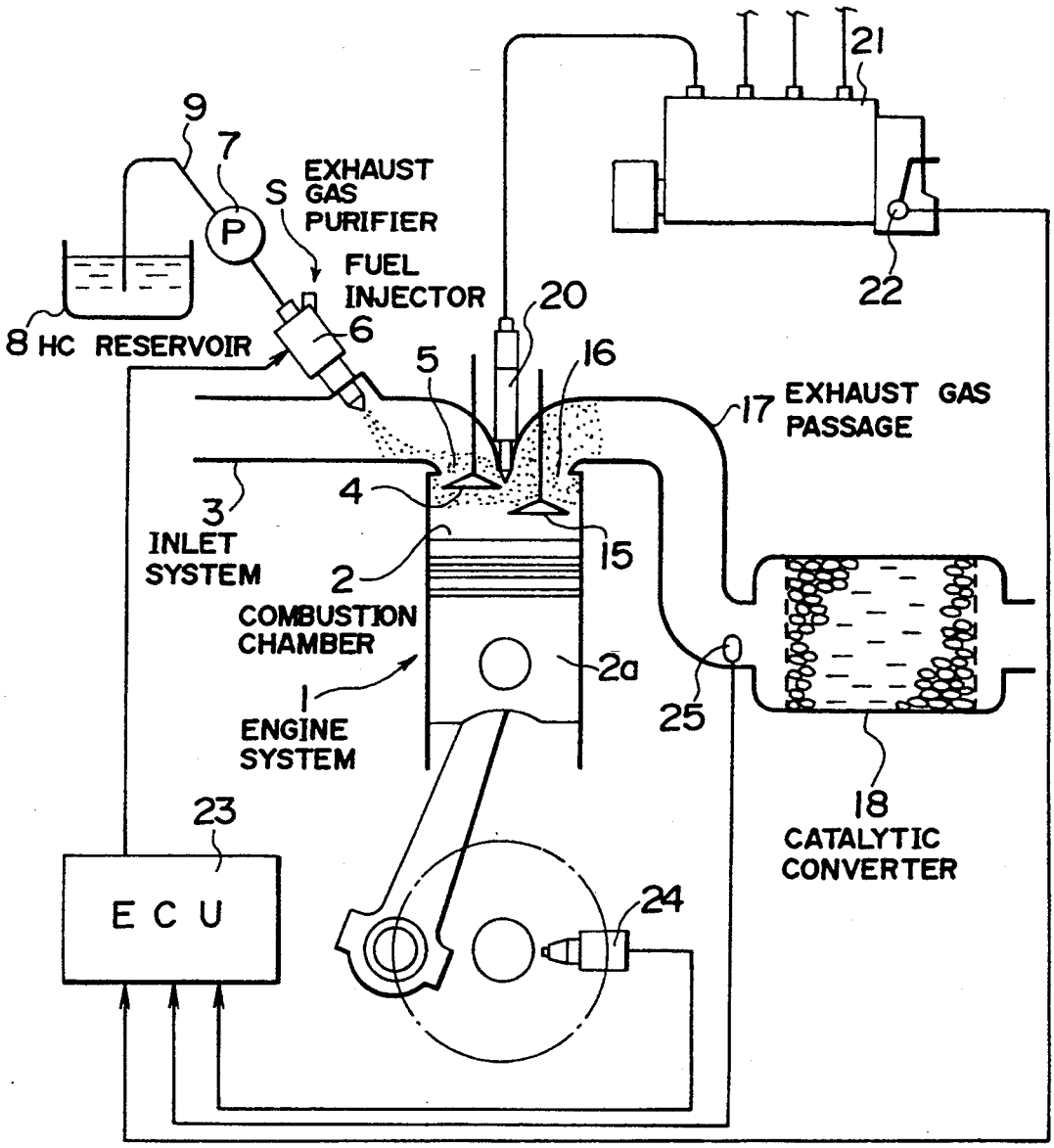
FIG. 9 shows an overall configuration of an exhaust gas purifier according to a third embodiment.
Figure 10:
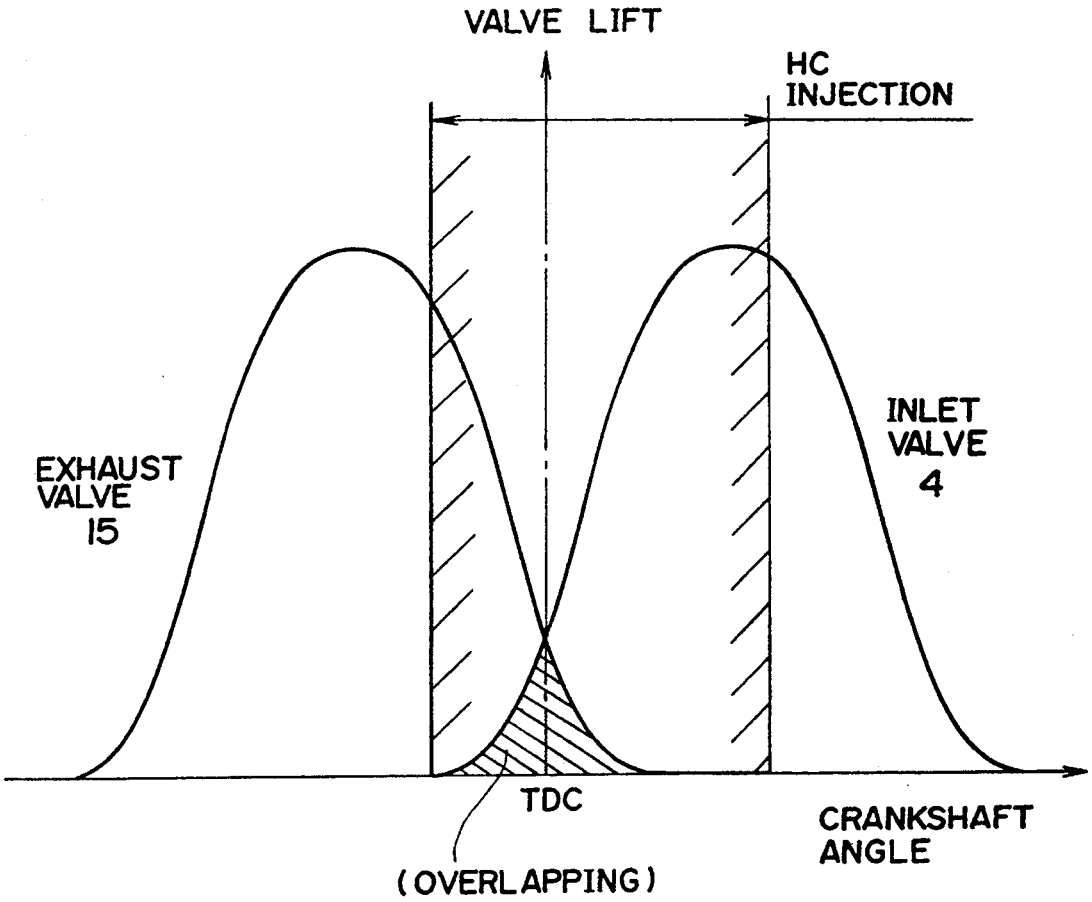
FIG. 10 shows HC injection timing corresponding to valve lift in the third embodiment.

FIGS. 9 and 10 show a third embodiment of this invention. In this embodiment, ECU 23 controls the HC injection timing of the fuel injector 6 in a manner which is different from the timing in the first embodiment.

As shown in FIG. 10, injection of HC is timed to be before the exhaust valve 15 is closed. Specifically, injection of HC is started prior to closure of the exhaust valve 15 or when the inlet valve 4 starts to open. In other words, both the exhaust valve 15 and the inlet valves, 4 remain open, i.e. during an overlapping period. Injection of HC is controlled to be continued even after the overlapping period is finished by the closure of the exhaust valve 15, and to be then interrupted when the inlet valve 4 starts to close.

FIG. 9 shows how HC from the fuel injector 6 blows through the combustion chamber 2 to reach the exhaust gas passage 17 while both the inlet valve 4 and the exhaust valve 15 remain open during the overlapping period.

The hydrocarbon blowing through the combustion chamber 2 and reaching the exhaust gas passage 17 contains a lot of saturated hydrocarbon. The exhaust gas having such saturated hydrocarbon passes through the zeolite catalyst converter 18, so that especially hydrogeneous zeolite catalyst or coppery zeolite zeolite catalyst in the catalytic converter 18, is activated by the saturated hydrocarbon as the reduction agent. The saturated hydrocarbon is inferior to the unsaturated hydrocarbon as the reduction agent. The zeolite catalyst converter 18 efficiently cracks NOx into $N_2$ and $O_2$, so that the exhaust gas with less NOx will be discharged.

Part of HC from the fuel injector 6 blows through the combustion chamber 2, for thereby suppressing unstable combustion of the fuel, which is caused by a large amount of HC sticking on the wall, and preventing a relatively low temperature of the combustion chamber 2. Further, it is also possible to suppress an increase of the blow-by gas in a crank case because little HC moves downwardly on the relatively low temperature wall of the combustion chamber 2. Dilution of lubrication oil can be also suppressed at the bottom of the crank case.

HC staying in the combustion chamber 2 is bunred, for promoting combustion of the main fuel as described with reference to the first embodiment, and decreasing generation of the soot. Therefore, the zeolite catalyst converter 18 is protected against poisoning by the soot, and exhaust gas containing a large amount of unsaturated hydrocarbon is generated during the combustion stroke, which efficiently activates the zeolite catalyst converter 18.

According to this embodiment, supply of HC to the inlet system decreases the soot and activates the zeolite catalyst converter 18 by the unsaturated hydrocarbon. This embodiment also prevents unstable combustion of the fuel due to supply of much HC to the inlet system and decreases NOx as efficiently as an exhaust gas purifier which includes an HC supply source inserted in the exhaust gas passage.

In the foregoing embodiments, the coppery zeolite catalyst or hydrogeneous zeolite catalyst is exemplified as a preferable sample of the zeolitic catalyst. Further, the following catalysts are conceivable: iron zeolite catalyst (Fe/ZSM-5), cobalt zeolite catalyst (Co/ZSM-5), sodium zeolite catalyst (Na/ZSM-5), and zinc zeolite catalyst (Zn/ZSM-5). Alumina catalyst ($Al_2O_3$), zirconia catalyst ($ZrO_2$) and titanium catalyst ($Co/TiO_2$) may be also usable.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust gas purifier for a diesel engine, comprising:

(a) a main fuel injection nozzle for supplying a main fuel to a combustion chamber of the diesel engine;

(b) HC supply means for supplying HC (hydrocarbon), said HC supply means being located in an inlet system for supplying air to the combustion chamber;

(c) a converter located in an exhaust gas passage for guiding exhaust gas from said combustion chamber, said converter being activated by hydrocarbon as a reduction agent to crack $NO_X$ (oxides of nitrogen);

(d) an inlet valve for enabling and disabling communication between said combustion chamber and an inlet port, said HC supply means comprises a fuel injector for injecting HC to said inlet port; and (e) an exhaust valve for enabling and disabling communication between said combustion chamber and an exhaust port, wherein supply of HC is started prior to closure of said exhaust valve and part of HC is introduced to the exhaust passage from said HC supply means during an overlapping period in which both said inlet valve and said exhaust valve remain open.

2. An exhaust gas purifier for a diesel engine, comprising:

(a) a main fuel injection nozzle for supplying a main fuel to a combustion chamber of the diesel engine;

(b) HC supply means for supplying HC (hydrocarbon), said HC supply means being located in an inlet system for supplying air to the combustion chamber and is operated when the diesel engine is working in a range where a large amount of $NO_X$ is being formed, wherein data concerning the range where a large amount of $NO_X$ is formed are stored based on an engine load and an engine speed; and (c) a converter located in an exhaust gas passage for guiding exhaust gas from said combustion chamber, said converter being activated by hydrocarbon as a reduction agent to crack $NO_X$ (oxides of nitrogen).

3. An exhaust gas purifier for a diesel engine, comprising:

(a) a main fuel injection nozzle for supplying a main fuel to a combustion chamber of the diesel engine;

(b) HC supply means for supplying HC (hydrocarbon), said HC supply means being located in an inlet system for supplying air to the combustion chamber and is operated when the exhaust gas temperature exceeds a temperature for activating said converter, wherein a gas oil for the diesel engine is used as hydrocarbon HC;

(c) a fuel injection pump connected to said main fuel injection nozzle via a fuel pipe, said fuel injection pump delivering a pressurized fuel to said main fuel injection nozzle and bypassing part of the fuel to said HC supply means;

(d) a converter located in an exhaust gas passage for guiding exhaust gas from said combustion chamber, said converter being activated by hydrocarbon as a reduction agent to crack $NO_X$ (oxides of nitrogen); and (e) a plurality of combustion chambers which are operated in time relationship with one another so that when first predetermined combustion chambers are in the inlet stroke, second predetermined combustion chambers are beginning the explosion stroke and the fuel supplied to said main fuel injection nozzles associated with said combustion chamber in the explosion stroke is bypassed to said HC supply means associated with said combustion chamber in the inlet stroke.

4. A method for purifying exhaust gas in a diesel engine, comprising the steps of:

(a) supplying a main fuel to a combustion chamber of the diesel engine by a main fuel injection nozzle;

(b) supplying HC to an inlet system by HC supply means located in said inlet system by which air is supplied to said combustion chamber, wherein the amount of said main fuel supplied at said step (a) is determined so that a total of a calorific energy of HC from said HC supply means and a calorific energy of said main fuel is equivalent to a calorific energy of said main fuel of a diesel engine without said HC supply means;

(c) guiding exhaust gas from said combustion chamber by a converter located in an exhaust gas passage which is activated by HC as a reduction agent for cracking oxides of nitrogen in the exhaust gas;

(d) enabling and disabling communication between said combustion chamber and an inlet port by an inlet valve, wherein HC is injected into said combustion chamber during the inlet stroke by said HC supply means when said inlet valve remains open;

(e) enabling and disabling communication between said combustion chamber and an exhaust port by an exhaust valve, wherein supplying of HC is started prior to closure of said exhaust valve and part of HC is introduced to said exhaust gas passage from said HC supply means during an overlapping period in which both said inlet valve and said exhaust valve remain open; and (f) injecting HC into said inlet port by a fuel injector.

* * * * *